US007669513B2

(12) United States Patent
Niv et al.

(10) Patent No.: US 7,669,513 B2
(45) Date of Patent: Mar. 2, 2010

(54) MULTIPLE WEAPON SYSTEM FOR ARMORED VEHICLE

(75) Inventors: Moshe Niv, Shavey Zion (IL); Shlomo Alkaher, Haifa (IL); David Stavitsky, Rishon LeZion (IL); Adolf Schvartz, Haifa (IL)

(73) Assignee: Elbit Systems Ltd., Haifa (IL)

( * ) Notice: Subject to any disclaimer, the term of this patent is extended or adjusted under 35 U.S.C. 154(b) by 803 days.

(21) Appl. No.: 10/574,455

(22) PCT Filed: Oct. 5, 2004

(86) PCT No.: PCT/IL2004/000918

§ 371 (c)(1),
(2), (4) Date: Apr. 4, 2006

(87) PCT Pub. No.: WO2005/033611

PCT Pub. Date: Apr. 14, 2005

(65) Prior Publication Data

US 2007/0119296 A1 May 31, 2007

(30) Foreign Application Priority Data

Oct. 9, 2003 (IL) ..... 158338
Apr. 19, 2004 (IL) ..... 161487

(51) Int. Cl.
*F41A 27/18* (2006.01)

(52) U.S. Cl. ..... 89/40.03; 89/37.01; 89/37.03

(58) Field of Classification Search ..... 89/40.03, 89/37.17, 41.02, 41.05, 36.08, 37.01, 37.02, 89/37.03

See application file for complete search history.

(56) References Cited

U.S. PATENT DOCUMENTS

| | | | | | |
|---|---|---|---|---|---|
| 1,334,800 | A | * | 3/1920 | Schneider | 89/38 |
| 2,336,557 | A | * | 12/1943 | McCallister | 89/37.17 |
| 2,983,197 | A | * | 5/1961 | Panhard | 89/36.13 |
| 3,504,122 | A | * | 3/1970 | Ratliff, Jr. | 348/47 |
| 4,141,277 | A | * | 2/1979 | Bouillon | 89/38 |
| D251,289 | S | * | 3/1979 | Larson | D12/12 |
| 4,326,446 | A | | 4/1982 | Magnuson | |
| 4,336,743 | A | * | 6/1982 | Horn et al. | 89/37.03 |
| 4,446,772 | A | | 5/1984 | Eggers et al. | |
| 4,574,683 | A | * | 3/1986 | LeBlanc | 89/33.04 |

(Continued)

FOREIGN PATENT DOCUMENTS

DE 2 205 826 2/1972

(Continued)

*Primary Examiner*—Michael Carone
*Assistant Examiner*—Benjamin P Lee
(74) *Attorney, Agent, or Firm*—Merchant & Gould P.C.

(57) ABSTRACT

Land vehicle weapon system including a base mount coupled with a land vehicle, a weapon mount, a plurality of weapons coupled with the weapon mount, a weapon moving mechanism coupled between the base mount and the weapon mount, a plurality of moving elements coupled with at least one of the base mount, the weapon mount, the weapons, and with the weapon moving mechanism, a sensing mechanism coupled with at least one of the weapon mount, the weapons and the base mount, and at least one user interface coupled with the weapons, the weapon moving mechanism, the moving elements, and with the sensing mechanism, the user interface enabling a user to remotely operate the weapons, the weapon moving mechanism being operable to move the weapons between a plurality of configurations.

27 Claims, 15 Drawing Sheets

U.S. PATENT DOCUMENTS

| | | | | | |
|---|---|---|---|---|---|
| 4,574,685 | A | * | 3/1986 | Sanborn et al. | 89/37.14 |
| 4,583,444 | A | * | 4/1986 | Jackson | 89/36.13 |
| 4,601,230 | A | | 7/1986 | LeBlanc | |
| 4,616,127 | A | | 10/1986 | Whiting | |
| 4,686,888 | A | * | 8/1987 | Sanborn et al. | 89/37.13 |
| D308,187 | S | * | 5/1990 | Ottevaere et al. | D12/12 |
| 5,056,409 | A | * | 10/1991 | Allais et al. | 89/37.01 |
| 5,095,803 | A | * | 3/1992 | Allais et al. | 89/40.03 |
| 5,353,680 | A | * | 10/1994 | Tiomkin et al. | 89/37.03 |
| 5,648,632 | A | * | 7/1997 | Becker et al. | 89/41.05 |
| 6,269,730 | B1 | | 8/2001 | Hawkes et al. | |
| 6,691,600 | B2 | * | 2/2004 | Boudreau et al. | 89/1.815 |
| 6,733,227 | B2 | * | 5/2004 | Fitzgerald et al. | 414/486 |
| 6,769,347 | B1 | * | 8/2004 | Quinn | 89/41.05 |
| 6,907,812 | B1 | * | 6/2005 | Eckstedt | 89/37.01 |
| 7,086,318 | B1 | * | 8/2006 | Darnall | 89/1.815 |
| 7,210,391 | B2 | * | 5/2007 | Beckmann | 89/37.03 |
| 2003/0051599 | A1 | * | 3/2003 | Lundqvist et al. | 89/37.03 |
| 2004/0216597 | A1 | * | 11/2004 | Kohlstedt et al. | 89/40.03 |
| 2007/0261544 | A1 | * | 11/2007 | Philippe | 89/41.05 |
| 2008/0034954 | A1 | * | 2/2008 | Grober | 89/41.05 |

FOREIGN PATENT DOCUMENTS

| | | | |
|---|---|---|---|
| DE | 35 18551 | A1 | 11/1986 |
| EP | 1 128 152 | A2 | 8/2001 |
| EP | 1 191 303 | A2 | 3/2002 |
| WO | WO 01/88564 | A1 | 11/2001 |

* cited by examiner

MULTIPLE WEAPON SYSTEM FOR ARMORED VEHICLE

FIELD OF THE DISCLOSED TECHNIQUE

The disclosed technique relates to ammunition in general, and to methods and systems for activating a plurality of weapons from an armored vehicle, in particular.

BACKGROUND OF THE DISCLOSED TECHNIQUE

It is necessary to move the weapon of a vehicle, such as a cannon or a gun of a tank, a sub-machine gun on an armored vehicle, and the like, in order to place the weapon at the desired firing position. Systems and methods for changing the firing position of such a weapon are known in the art.

U.S. Pat. No. 4,326,446 issued to Magnuson, and entitled "Linkage of Actuating System for Elevating Gun Mount", is directed to a mechanism for elevating a gun from a tracked military vehicle. The mechanism includes a bracket secured to a turret of the tracked military vehicle, a lever, a first power cylinder, a second power cylinder, and a toggle linkage. The toggle linkage includes a relatively long link and a relatively short link. The bracket includes a first bracket pivot connection, a second bracket pivot connection and a third bracket pivot connection. The relatively short link includes a first short link pivot connection, a second short link pivot connection and a third short link pivot connection. The relatively long link includes a first long link pivot connection and a second long link pivot connection. The lever includes a first lever pivot connection and, second lever pivot connection and a third lever pivot connection. A receiver of the gun includes a first receiver pivot connection and a second receiver pivot connection.

The first lever pivot connection is connected to the first bracket pivot connection with a first pin. The second lever pivot connection is connected to the second short link pivot connection and to the first receiver portion of the gun, by a second pin. A first cylinder connection of the first power cylinder is connected to the third bracket pivot connection by a third pin. A first piston rod connection of the first power cylinder is connected to the third lever pivot connection by a fourth pin. A second cylinder connection of the second power cylinder is connected to the third short link pivot connection by a fifth pin. A second piston rod connection of the second power cylinder is connected to the second receiver connection by a sixth pin. The first long link pivot connection is connected to the first short link pivot connection by a seventh pin. The second long link pivot connection is connected to the second bracket pivot connection by an eighth pin.

The imaginary horizontal planes of the first short link connection and the second short link connection are spaced apart by a first vertical spacing. The imaginary horizontal planes of the third short link pivot connection and the second receiver pivot connection are spaced apart by a second vertical spacing. The mechanism is constructed such that the first vertical spacing is the same as the second vertical spacing. In order to raise the gun vertically above the turret and maintaining the gun horizontal, the first power cylinder is activated and the second power cylinder is de-activated. In order to change the elevation of the gun, the second power cylinder is activated and the first power cylinder is de-activated.

U.S. Pat. No. 4,446,772 issued to Eggers et al., and entitled "Large-Bore Twin-Weapon System for Combat Vehicles", is directed to a system for lifting a carrier of two weapons of a combat vehicle. The system includes the carrier, a first pivot, a second pivot, a third pivot, lifting means, aiming drives, a main support bearing, a step bearing, a journal, an eccentrically formed bearing ring, a first support arm, a second support arm and a hydro-accumulator.

The two weapons are supported rotatably at the carrier. The first pivot and the second pivot are connected to the carrier by the first support arm and the second support arm, respectively. The first pivot and the second pivot are connected to the combat vehicle. The lifting means is connected to the carrier, to the third pivot and to the hydro-accumulator. The third pivot is connected to the combat vehicle. The aiming drives, the main support bearing, the step bearing and the journal are located within the carrier. The aiming drive is located between the main support bearing and the step bearing. The journal is connected to the weapon and to the aiming drive.

The position of the journal and the weapon are altered when the eccentrically formed bearing ring of the step bearing is rotated. In this manner the weapons are point-aimable to a predetermined distance. The aiming drive transmits a torque to the journal for changing the elevation of the weapon. The first pivot and the second pivot are located on a first rotating axis, and the third pivot is located on a second rotating axis. The carrier and the weapons are lifted by the action of the hydro-accumulator, the lifting means and the third pivot. Each weapon is height-aimable independently. The lateral aiming of the weapons is affected by rotation of the combat vehicle about a height axis, or by a rotary device on the combat vehicle.

U.S. Pat. No. 4,601,230 issued to LeBlanc and entitled "Weapon System", is directed to a manually operated multiple weapon system for an armored vehicle turret. The system includes a main gun, a coaxial machine gun, two four barrel automatic grenade launchers, a turret, a basket assembly, a rotor mounting assembly and a hydraulic cylinder means. The turret is mounted on a roof portion of the armored vehicle. The basket assembly depends from the turret. The rotor mounting assembly is mounted to the turret. The main gun, the coaxial machine gun and the automatic grenade launchers are attached to the rotor mounting assembly.

The basket assembly accommodates a gunner and a commander. The basket assembly includes an ammunition storage box for feeding ammunition to the main gun, linked ejection chutes, a compartment and a manual elevation and trigger assembly. The linked ejection chutes guide the ejected ammunition links from the main gun through the rotor mounting assembly, into the compartment. The compartment opens to the outside of the armored vehicle for ejection of the propellant gases and the brass and rounds of the main gun. A machine gun ammunition storage box is positioned in the turret for feeding ammunition to the coaxial machine gun, through machine gun feed chutes. The hydraulic cylinder means is pivotally attached to the rotor mounting assembly and to the turret. The extension and retraction of the hydraulic cylinder means rotates the rotor mounting assembly.

The manual elevation and trigger assembly includes a handle, a pump, a gear box assembly and a trigger button. By operating the manual elevation and trigger assembly, the gunner manually elevates and fires the main gun. As the handle is turned, the gear box assembly is turned, thereby activating the pump and pressurizing the hydraulic cylinder means. When the trigger button is depressed the main gun fires, and when the trigger button is released, the firing stops.

U.S. Pat. No. 4,616,127 issued to Whitting and entitled "Fire Control System for a Vehicle or Vessel", is directed to a fire control system for a vehicle to compensate for the roll, pitch and yaw motions of the vehicle, and provide the true target motion to the gun, despite the gun recoil and the rocking motions of the vehicle driving on hilly ground. The vehicle is fitted with a spring-suspended chassis on pneumatic tires.

The fire control system includes a turret, a gun, a target tracking unit, a plurality of servo control units, reference orientation means, a plurality of angle data transmitters, a data processor and a fire control computer. The target tracking unit includes a radar tracking apparatus, a laser range detector, an infrared tracking unit, a TV tracking unit and optical detection means. The fire control computer includes an aiming point generator, a first coordinate conversion unit and a transformation unit.

The gun is mounted on the turret. The turret is rotatable about a first axis perpendicular to a roof of the vehicle. The gun is movable in elevation about a second axis parallel to the roof. The target tracking unit is biaxially connected with the turret. The target tracking unit can rotate about a third axis parallel or coaxial with the first axis, and about a fourth axis parallel with the roof.

The servo control units are connected with the turret, the gun, the target tracking unit, the data processor and with the fire control computer. The reference orientation means and the angle data transmitters are connected to the turret, the gun, the target tracking unit and with the fire control computer. The data processor is connected with the target tracking unit and with the fire control computer.

The fire control computer calculates aiming values for the gun, according to the angle and range data from the target tracking unit, and according to orientation data from the reference orientation means. The fire control computer operates the servo control units according to the calculated aiming values.

U.S. Pat. No. 6,269,730 issued to Hawkes et al., and entitled "Rapid Aiming Telepresent System" is directed to a system for remotely aiming a firearm at a target. The system includes a hand controller, display means, a pointing device and a control unit. The hand controller includes a portable viewfinder, a two-axis joystick, stereo headphone speakers, visual indicators, a tactile signal generator, and a plurality of controls. The display means includes two computer display screens. The pointing device includes a firearm, a carriage, a base, a first rotational mount, a second rotational mount, a first linear actuator and a second linear actuator. The control unit includes a microprocessor.

The firearm is mounted to the carriage. The carriage is connected to the base by the first rotational mount and the second rotational mount. The first linear actuator is attached to the base and to the carriage. The second linear actuator is attached to the first rotational mount and to the carriage. The first rotational mount rotates the carriage along a first axis which is approximately vertical. The second rotational mount rotates the carriage along a second axis which is approximately horizontal.

The hand controller is connected to the control unit by a transmission cable. The control unit transmits electrical control signals to the first linear actuator and to the second linear actuator, via control signal transmission means. The computer display screens display a live video image of the area in the vicinity of the target as well as the current pointing direction. The user operates the hand controller according to the images on the computer display screens. The control unit sends electrical control signals to the first linear actuator and the second linear actuator, to actuate the first linear actuator and the second linear actuator, according to the signals received from the hand controller. The first linear actuator and the second linear actuator move the carriage along the first axis and the second axis, respectively. The control unit produces a first audio signal and a second audio signal at the stereo headphone speakers, according to the actuation speed of the first linear actuator and the second linear actuator, respectively.

SUMMARY OF THE DISCLOSED TECHNIQUE

It is an object of the disclosed technique to provide a novel system for moving the weapons of a land vehicle to different configurations.

In accordance with the disclosed technique, there is thus provided a land vehicle weapon system which includes a base mount, a weapon mount, a plurality of weapons, a weapon moving mechanism, a plurality of moving elements, a sensing mechanism, and at least one user interface. The base mount is coupled with the land vehicle. The weapons are coupled with the weapon mount. The weapon moving mechanism is coupled between the base mount and the weapon mount.

The moving elements are coupled with at least one of the base mount, the weapon mount, the weapons, and with the weapon moving mechanism. The sensing mechanism is coupled with at least one of the weapon mount, the weapons and with the base mount. The user interface is coupled with the weapons, the weapon moving mechanism, the moving elements, and with the sensing mechanism. The weapon moving mechanism is operable to move the weapons between a plurality of configurations, and the user interface enables a user to remotely operate the weapons.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a system which includes a plurality of weapons, wherein each weapon can be operated remotely from inside of the land vehicle. The system includes a mechanism for lowering the weapons to a retracted configuration, and for raising the weapons back to a combat configuration.

The term "land vehicle" herein below refers to an armored vehicle as well as a non-armored vehicle which can travel on ground. The land vehicle can be an unmanned vehicle (i.e., autonomously operated or remote controlled) as well as a vehicle occupied and operated by a human being. The land vehicle can move on wheels (i.e., wheel driven), on caterpillar traction (i.e., track driven, such as a tank), or a combination thereof. The term "elevation" herein below refers to the angular distance of a weapon relative to the horizon. Hence, a positive elevation refers to an angle above the horizon, and a negative value refers to an angle below the horizon. The term "azimuth" herein below refers to the horizontal direction of the weapon expressed as an angle relative to a reference direction.

The term "roof" herein below, refers to a panel of the land vehicle to which the weapon system is attached (e.g., the top surface of the land vehicle, the side surface of the land vehicle). Accordingly, the term "height" herein below, refers to a distance away from the roof.

Figure 1:
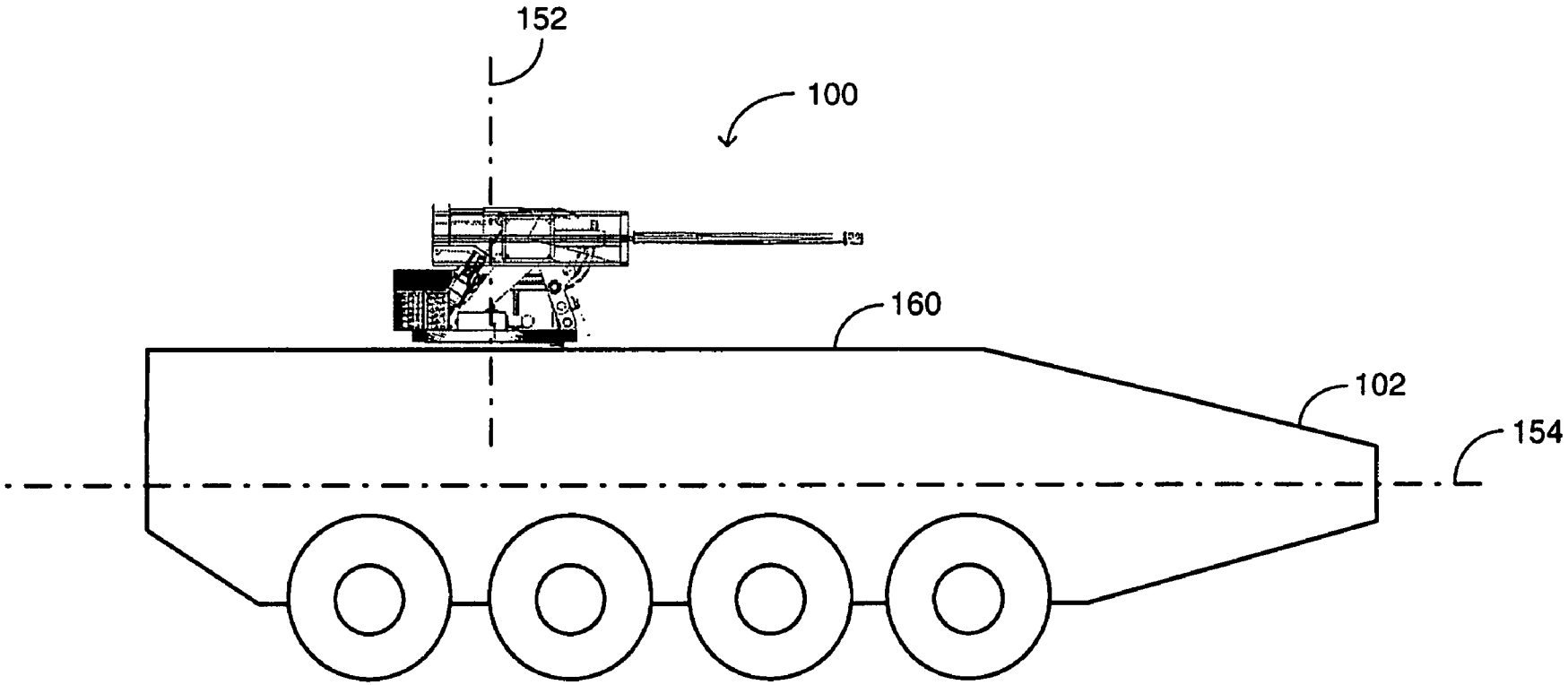
FIG. 1 is a perspective view of an exposed portion of a land vehicle weapon system in a static firing configuration, constructed and operative in accordance with an embodiment of the disclosed technique, and installed on a land vehicle.
Figure 2:
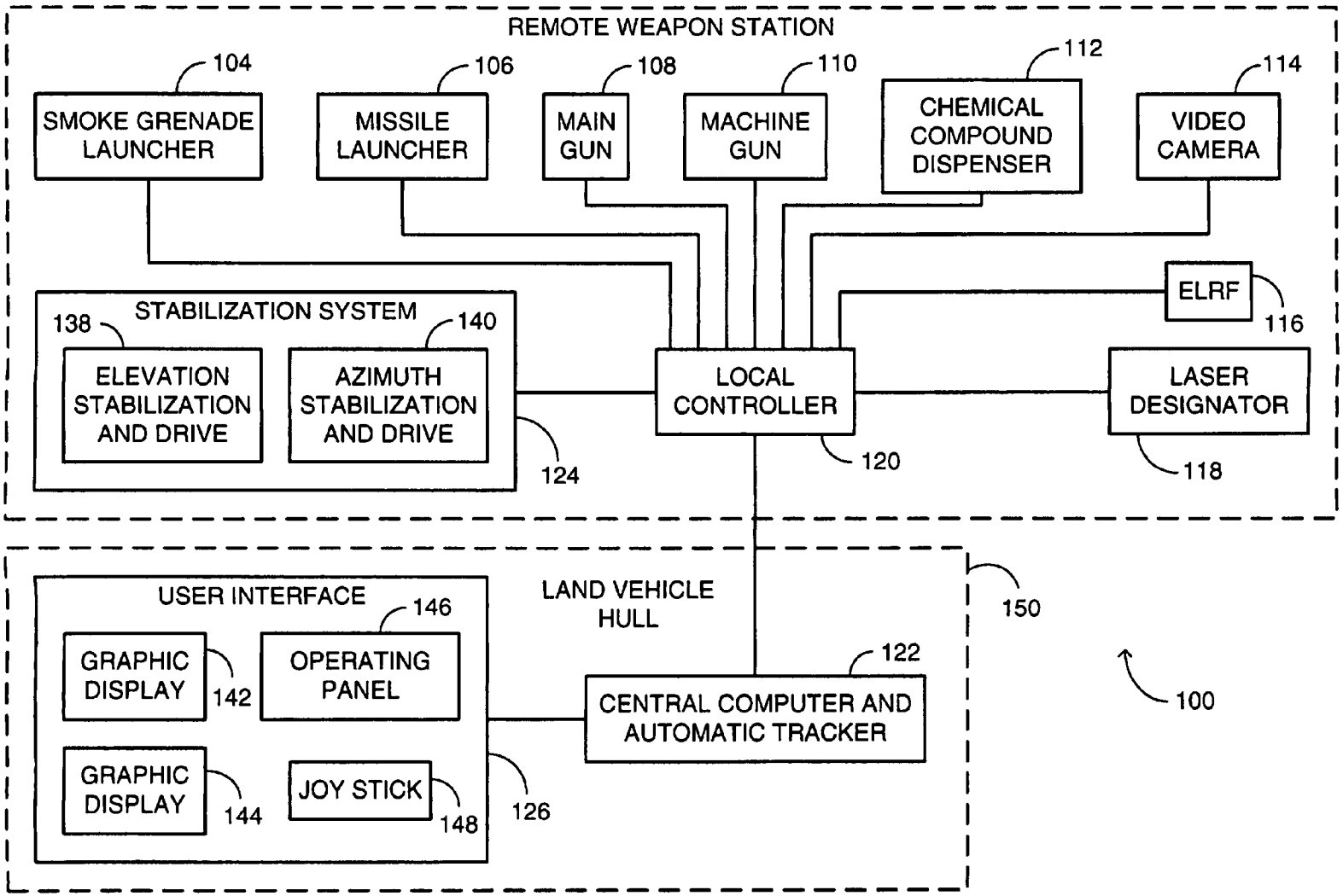
FIG. 2 is a schematic illustration of a block diagram of the land vehicle weapon system of FIG. 1.
Figure 3:
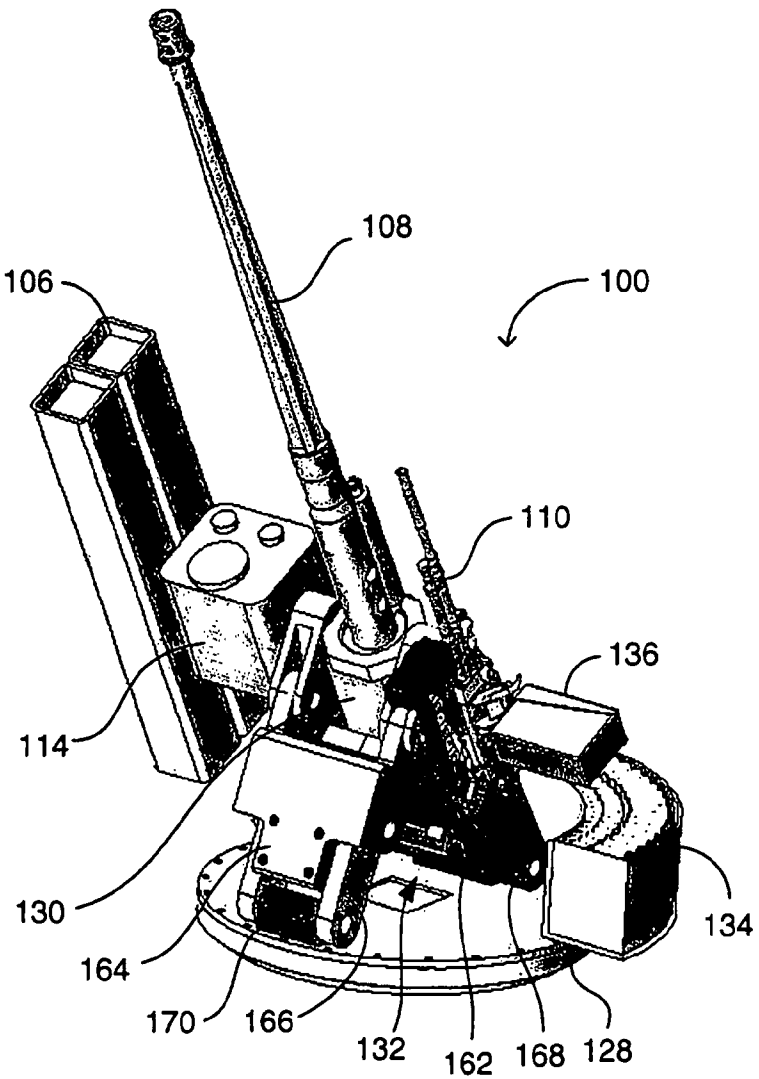
FIG. 3 is a perspective front view of the exposed portion of the land vehicle weapon system of FIG. 1, in a static firing configuration.
Figure 4:
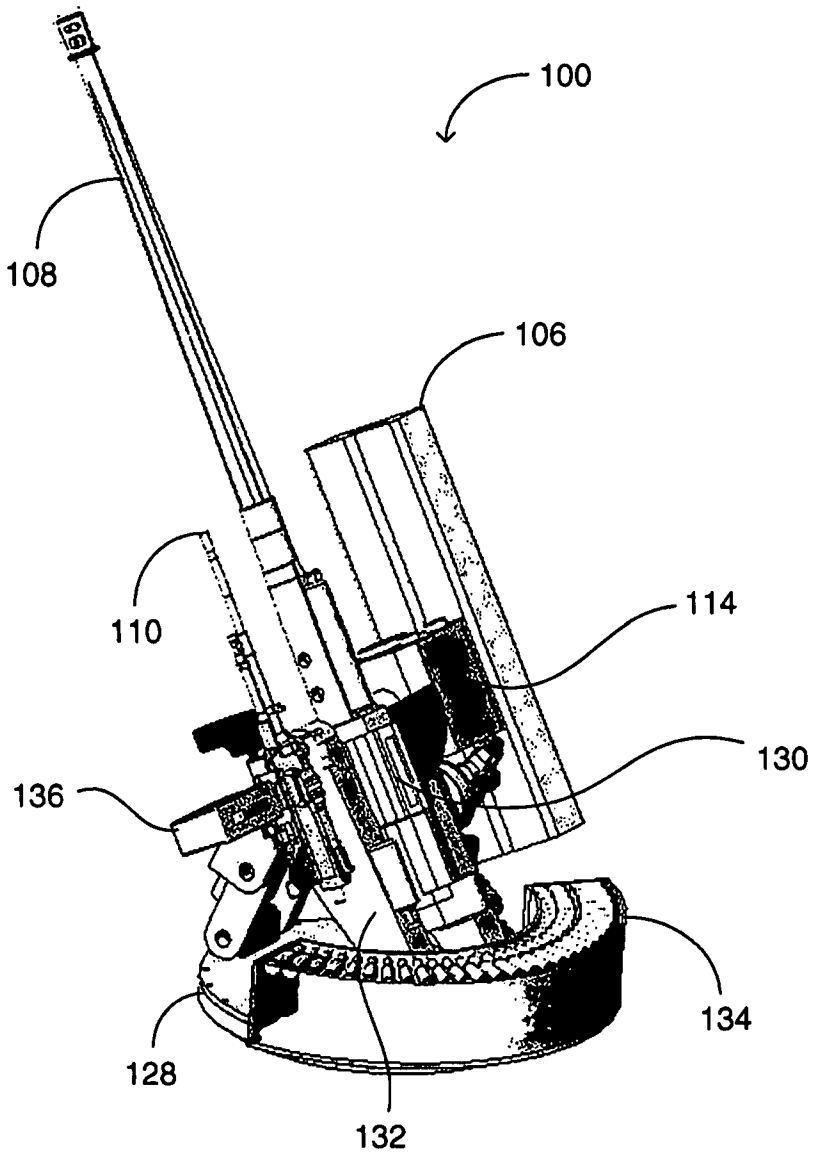
FIG. 4 is a perspective rear view of the exposed portion of the land vehicle weapon system of FIG. 1, in another static firing configuration.

Reference is now made to FIGS. 1, 2, 3 and 4. FIG. 1 is a perspective view of an exposed portion of a land vehicle weapon system in a static firing configuration, generally referenced 100, constructed and operative in accordance with an embodiment of the disclosed technique, and installed on a land vehicle generally referenced 102. FIG. 2 is a schematic illustration of a block diagram of the land vehicle weapon system of FIG. 1. FIG. 3 is a perspective front view of the exposed portion of the land vehicle weapon system of FIG. 1, in a static firing configuration. FIG. 4 is a perspective rear view of the exposed portion of the land vehicle weapon system of FIG. 1, in another static firing configuration.

System 100 includes an automatic grenade launcher 104, a missile launcher 106, a primary gun 108, a secondary gun 110, a chemical compound dispenser 112, sensing mechanisms 114 and 116, a laser designator 118, controllers 120 and 122, a stabilization system 124, a user interface 126, a base mount 128 (FIGS. 3 and 4), a weapon mount 130, a weapon moving mechanism 132, a plurality of moving elements (not shown), ammunition cartridges 134 and 136, and one or more gyroscopes (not shown). In the description herein below, automatic grenade launcher 104, missile launcher 106, primary gun 108, secondary gun 110, chemical compound dispenser 112, sensing mechanisms 114 and 116, and laser designator 118 are collectively referred to as "weapons". It is noted that system 100 can include other types of weapon systems (e.g., a simple automatic grenade launcher) camouflage units, imaging systems, and the like.

Automatic grenade launcher 104 launches a plurality of smoke grenades, explosive grenades, and the like, toward the target. Missile launcher 106 launches a plurality of missiles, such as land-to-land missile, land-to-air missile, antitank missile, guided missile, target-tracking missile, and the like, toward the target. Primary gun 108 is a canon, mortar, and the like. Secondary gun 110 is a machine gun, sub-machine gun, coaxial machine gun, rifle, and the like. Chemical compound dispenser is a device which dispenses a chemical compound toward the target, such as smoke (e.g., to reduce visibility), a gas (e.g., tear gas, nitrogen oxide—NO), a foam (e.g., to solidify upon contact and to immobilize the suspect), a liquid (e.g., high pressure water to counteract riots, a compound which forms into a web around the suspect and immobilizes him), and the like.

Each of sensing mechanisms 114 and 116 includes either one or more sensors or one or more imaging systems. The sensor is a laser sensor, sonic sensor, radar sensor, and the like, for example for determining the range of the target (i.e., a range-finder). Alternatively, the sensor is a mechanical sensor for example for determining the velocity, acceleration, elevation, azimuth, and the like.

The imaging system is a charged-coupled device (CCD), video camera, and the like. The video camera can operate either in a visible range of wavelengths or a non-visible range of wavelengths, such as far infrared, near infrared, and the like (e.g., night-vision camera, forward looking infrared radiometer—FLIR). The imaging system can be employed for aiming automatic grenade launcher 104, missile launcher 106, primary gun 108, secondary gun 110, chemical compound dispenser 112, and laser designator 118 toward the target, for observation, for target acquisition, and the like.

Laser designator 118 is a device which directs laser toward the target for a missile (not shown), to lock on the target. The missile can be launched either from land vehicle 102, or from another location on the Earth, such as land, sea, air or an ice bed.

Each of controllers 120 and 122 can include a respective processor (not shown). Controller 122 includes a target tracking system (not shown), which operates according to signals received from sensing mechanisms 114 and 116, to track the target. Stabilization system 124 operates in conjunction with the target tracking system, in order to stabilize the orientation of the weapons. Stabilization system 124 stabilizes the orientation of the weapons according to the movement of land vehicle 102, in order to substantially keep the weapons locked on to the target (not shown), in spite of the movement of land vehicle 102. For this purpose, stabilization system 124 can include a plurality of modules 138 and 140, for example to stabilize the elevation and the azimuth of the weapons. In addition, stabilization system 124 can include one or more moving elements and one or more sensing mechanisms, to provide the required stabilization. A first communication interface can be coupled with controller 120 and a second communication interface can be coupled with controller 122, thereby enabling controllers 120 and 122 to communicate either via a conductive path, or a wireless path.

Each of the moving elements can be in the form of an electric actuator (e.g., rotary electric motor, linear electric motor, electromagnet), hydraulic actuator (e.g., hydraulic cylinder, hydraulic motor), pneumatic actuator (e.g., pneumatic cylinder), and the like. Each of the moving elements can include power transmission elements, such as gears, pulleys, belts, bearings, links, and the like. Ammunition cartridges 134 and 136 include a plurality of shells, bullets, and the like, to be loaded into primary gun 108 and secondary gun 110, respectively.

User interface 126 includes a plurality of visual interfaces 142 and 144 and a plurality of tactile interfaces 146 and 148. Each of visual interfaces 142 and 144 can be a television display, screen touch display, head-up display (HUD), biocular display, stereoscopic display, autostereoscopic display, binocular display, periscope, and the like. Each of tactile interfaces 146 and 148 can be a keyboard, joystick, switch, touchpad, conductive tablet and wand, and the like. User interface 126 can include an audio device such as a microphone (not shown), speaker (not shown), and the like. User interface 126 can also include a haptic device (not shown), to provide a sense of force, velocity, acceleration, surface roughness, and the like, to the user (not shown).

Weapon moving mechanism 132 is in form of a four bar linkage which includes a first link 162, a second link 164 and a third link 166, where base mount 128 forms the fourth link. First link 162 is coupled with base mount 128 at a first joint 168, while third link 166 is coupled with base mount 128 at a second joint 170. Second link 164 is coupled with first link 162 and with third link 166. Weapon mount 130 is coupled with first link 162. Each of the moving elements can be in form of an actuator (not shown). The actuator is coupled with first link 162, in order to rotate first link 162 about first joint 168. Additional actuators can be coupled with weapon moving mechanism 132, for example at second joint 170.

The weapons, base mount 128, weapon mount 130, weapon moving mechanism 132, the moving elements, ammunition cartridges 134 and 136 are all located external to land vehicle 102 and do not penetrate a hull 150 of land vehicle 102. Hence, the configuration of hull 150 remains unchanged, which retains the original characteristics of the work space, available for the crew members (not shown) of land vehicle 102. according to an embodiment of the disclosed technique, controller 122 and user interface 126 can be located within hull 150 of land vehicle 102.

System 100 can include an electric power supply—not shown (either alternating current or direct current), non-rechargeable battery, rechargeable battery, fuel cell, renewable power supply (e.g., photovoltaic system, solar thermal electric system, wind operated turbine), non-renewable power supply (e.g., based on fossil fuel, alcohol, methanol, natural gas, radioactive material), and the like. Alternatively, each of the weapons, controllers 120 and 122, stabilization system 124, user interface 126, weapon moving mechanism 132, and the moving elements can include a connector to be connected to the power supply (not shown) of land vehicle 102.

Controller 120 is coupled with the weapons, controller 122, stabilization system 124, weapon moving mechanism 132 and with the moving elements, either by a conductive, a wireless link, or a combination thereof. Controller 122 is coupled with user interface 126 either by a conductive, a wireless link, or a combination thereof.

Base mount 128 is coupled with a portion of a roof 160 (FIG. 1) of land vehicle 102, external to land vehicle 102. Weapon moving mechanism 132 is coupled between base mount 128 and weapon mount 130. The weapons, stabilization system 124, and the respective moving elements are coupled with weapon mount 130. Ammunition cartridge 134 is coupled with base mount 128 and with primary gun 108. Ammunition cartridge 136 is coupled with secondary gun 110. The respective moving elements are coupled with weapon moving mechanism 132 and with base mount 128.

Base mount 128 can rotate in a full circle about a vertical axis 152 (FIG. 1) substantially perpendicular to a longitudinal axis 154 of land vehicle 102, with the aid of the moving elements. In this manner, the azimuth of the weapons can be changed.

Weapon moving mechanism 132 moves the weapons to any of the following configurations:

- Transportation configuration, wherein the weapons lie horizontally substantially close to roof 160 (FIG. 1) of land vehicle 102, as described herein below in connection with FIGS. 5A and 6A. At this configuration the overall height of land vehicle 102 is low enough to enter the cargo bay (not shown) of a cargo vehicle.
- Static firing configuration, wherein the weapons are at the maximum height and in a configuration suitable for combat, as illustrated in FIGS. 3 and 4 and described herein below in connection with FIG. 6B.
- Combined configuration, wherein the weapons are at one of a plurality of configurations between the transportation configuration and the static firing configuration, and still in a configuration suitable for combat, as described herein below in connection with FIGS. 8A and 8B.

Furthermore, each of the weapons can include a moving element for changing the elevation of the respective weapon at the static firing configuration and at the combined configuration, wherein weapon mount 130 is substantially stationary relative to weapon moving mechanism 132. In addition or alternatively, the moving elements change the elevation of the weapons at the static firing configuration and at the combined configuration, wherein weapon mount 130 moves relative to weapon moving mechanism 132. Weapon moving mechanism 132 moves weapon mount 130 and thus the weapons, along vertical axis 152 (FIG. 1), thereby varying the height of the weapons above roof 160. Thus, with the aid of user interface 126, the user can remotely and from the inside of land vehicle 102, operate either one of the weapons, move the weapons to any of the transportation configuration, static firing configuration, or combined configuration, and adjust the elevation of the weapons at the static firing configuration or the combined configuration.

It is noted that in any of the transportation configuration, static firing configuration, or combined configuration, those parts of system 100 which occupy a large space, such as the weapons, base mount 128, weapon mount 130, weapon moving mechanism 132, the moving elements, ammunition cartridges 134 and 136, are all located external to land vehicle 102 and do not penetrate hull 150 of land vehicle 102.

Figure 5A:
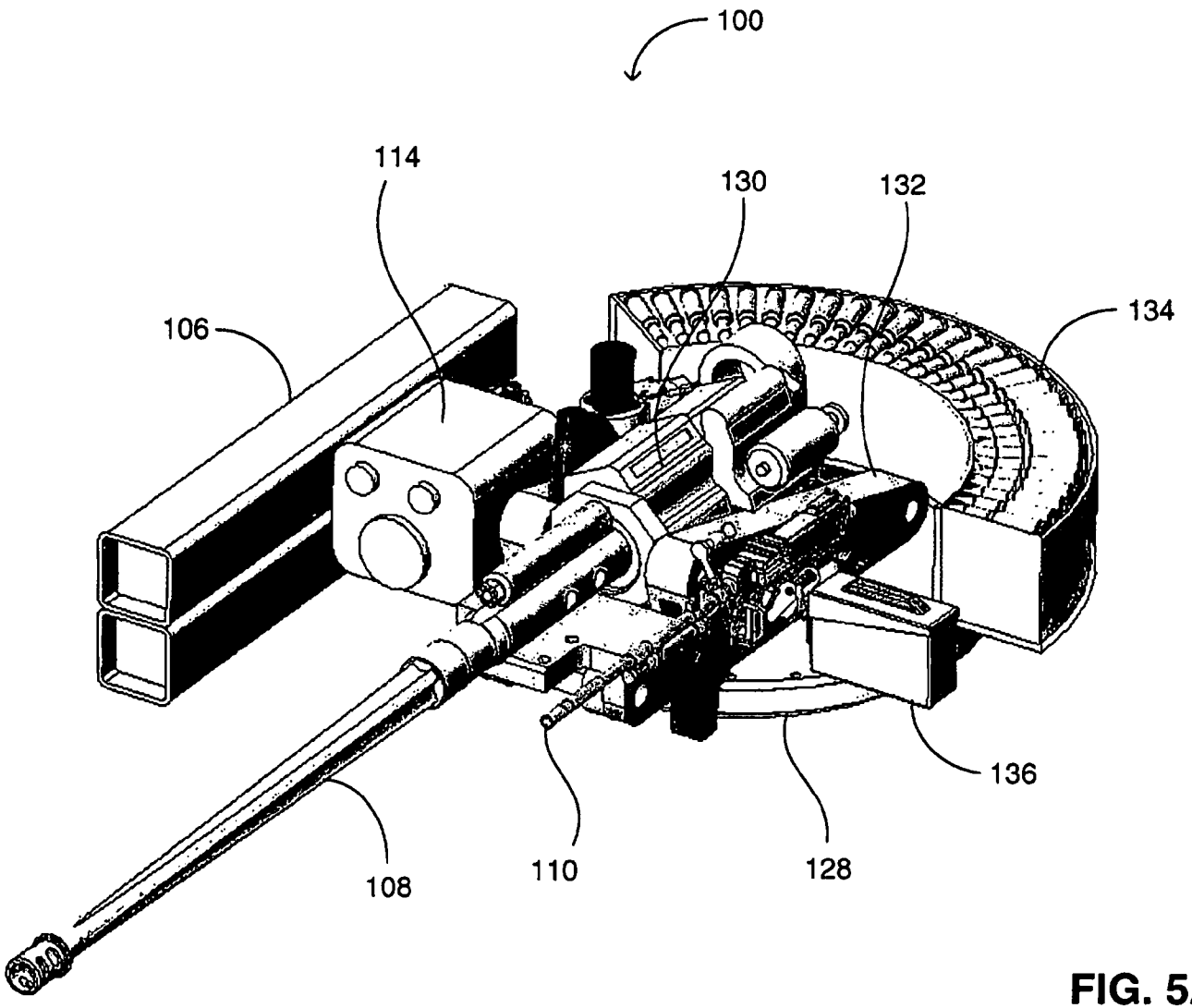
FIG. 5A is a perspective top view of the exposed portion of the land vehicle weapon system of FIG. 1, in a transportation configuration.
Figure 5B:
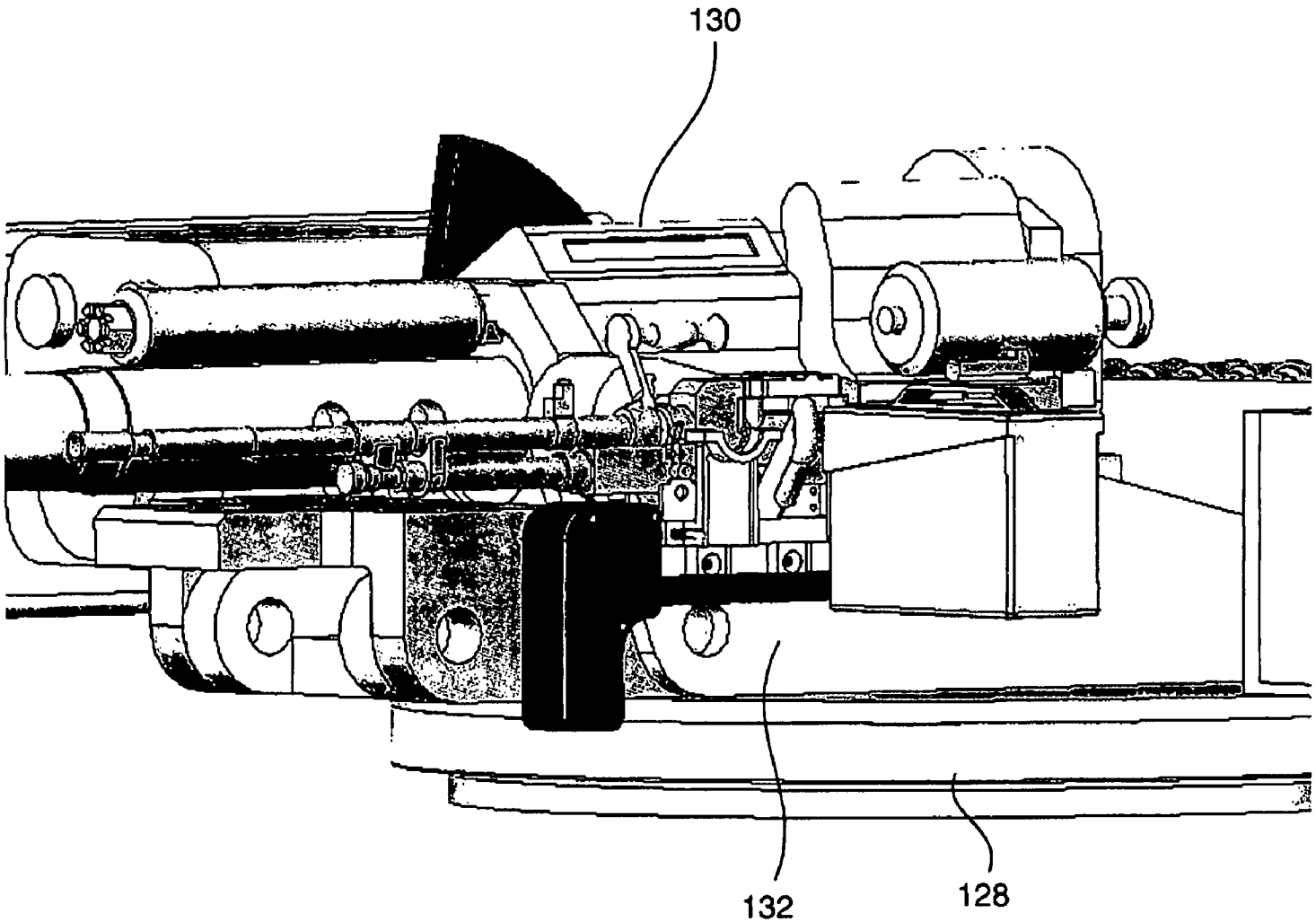
FIG. 5B is a detail perspective side view of the exposed portion of the land vehicle weapon system of FIG. 1, in the transportation configuration of FIG. 5A.
Figure 5C:
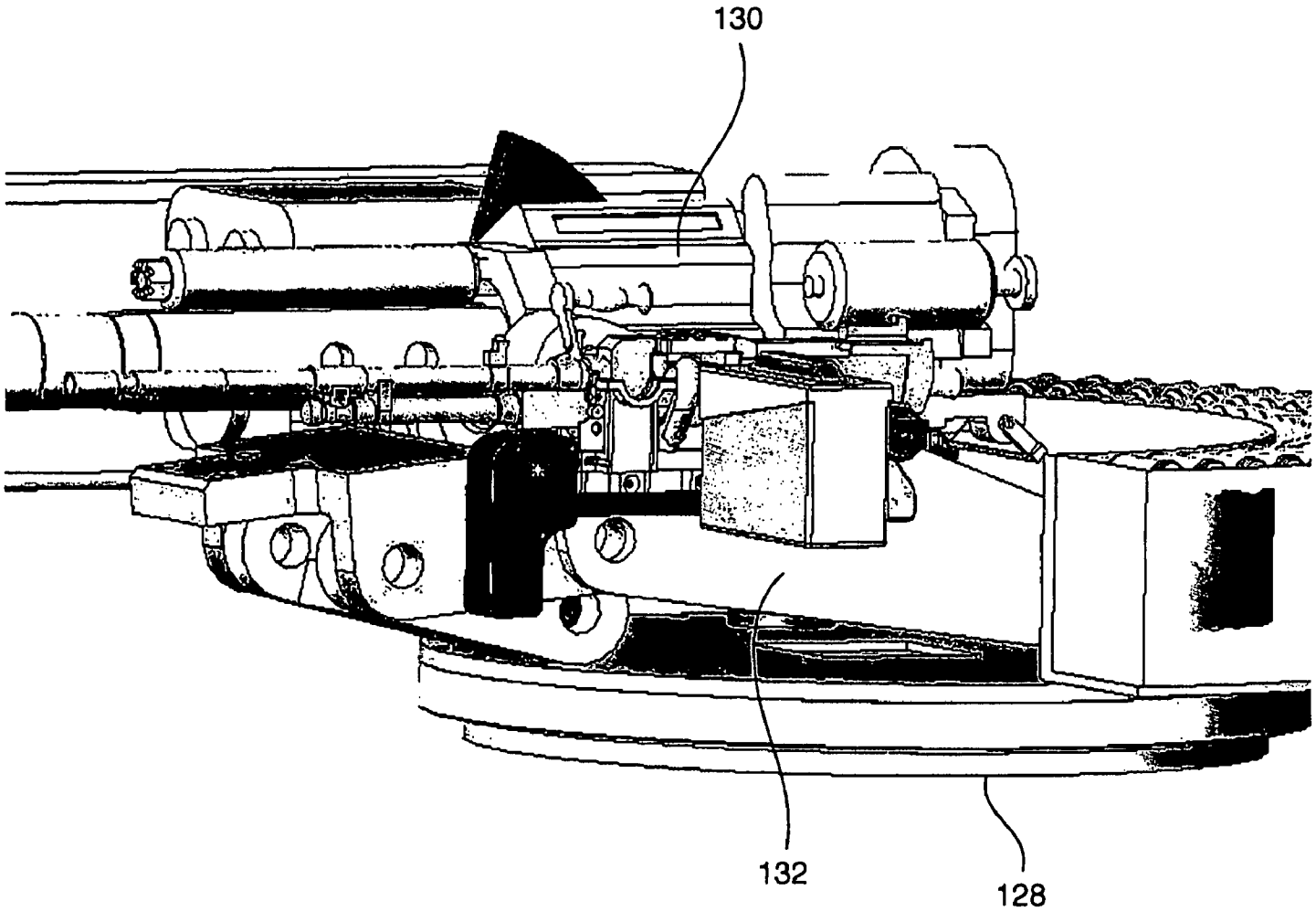
FIG. 5C is a detail perspective side view of the exposed portion of the land vehicle weapon system of FIG. 1 in a combined configuration.
Figure 5D:
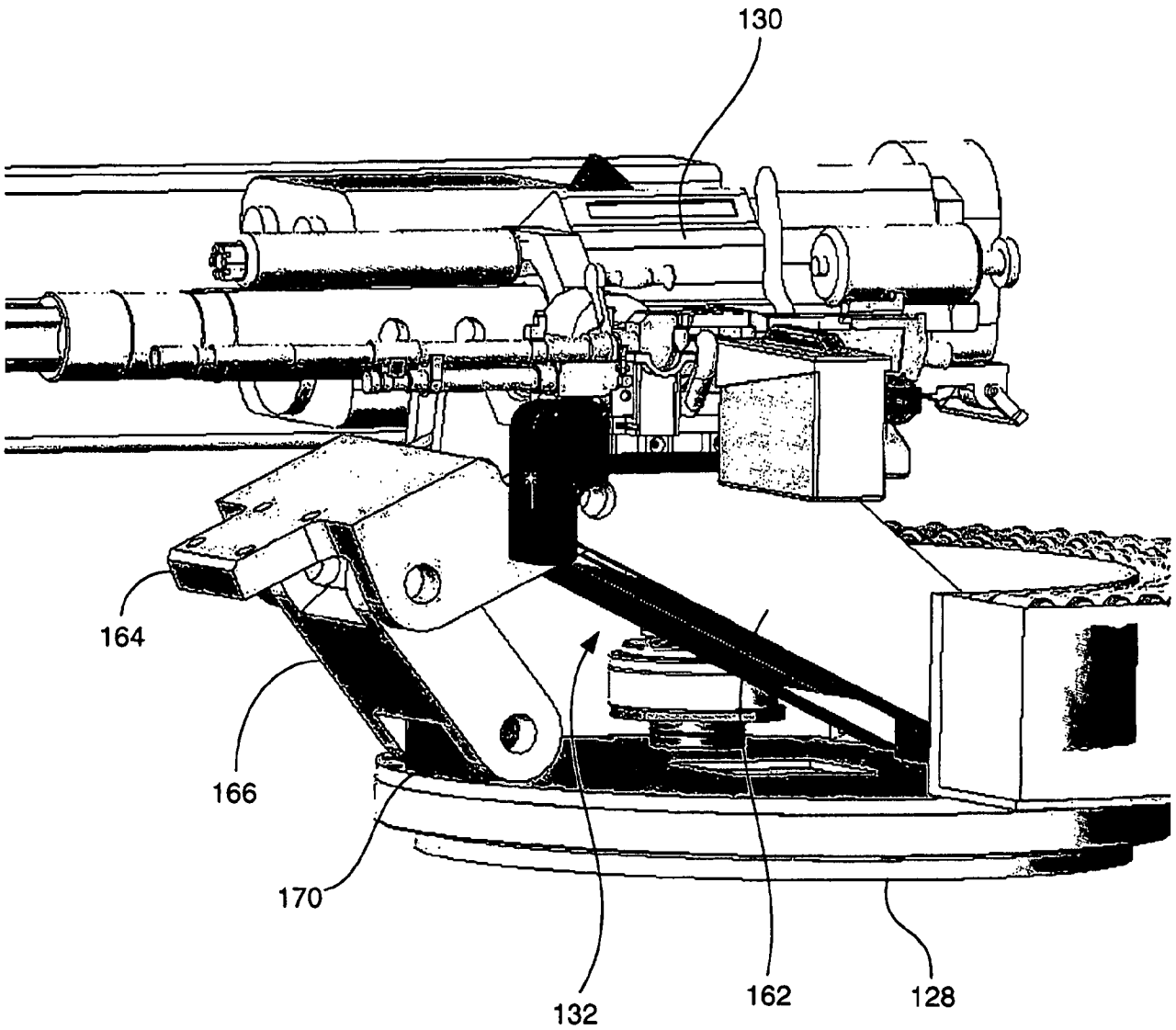
FIG. 5D is a detail perspective side view of the exposed portion of the land vehicle weapon system of FIG. 1 in another combined configuration.
Figure 5E:
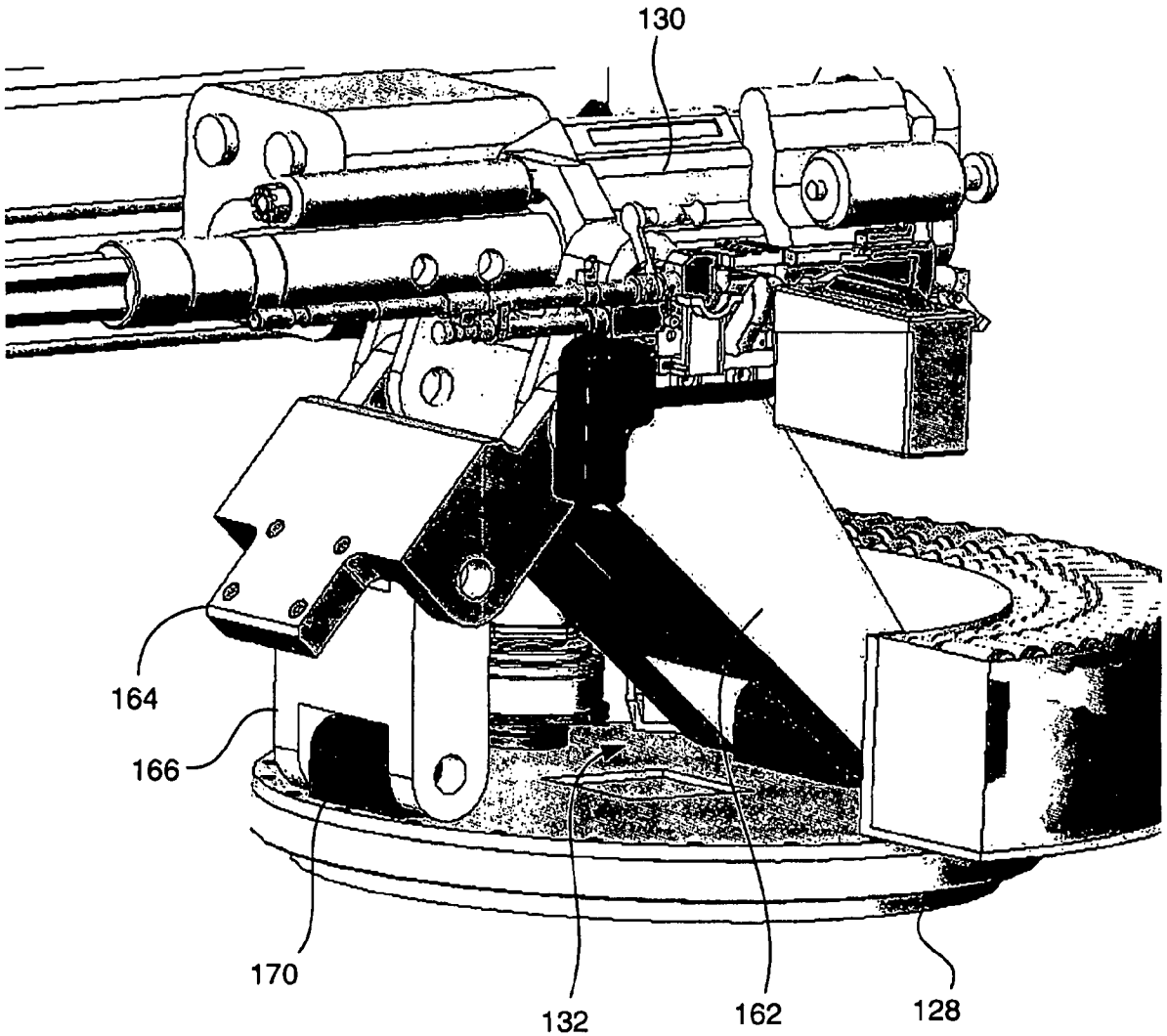
FIG. 5E is a detail perspective side view of the exposed portion of the land vehicle weapon system of FIG. 1 in a further combined configuration.
Figure 5F:
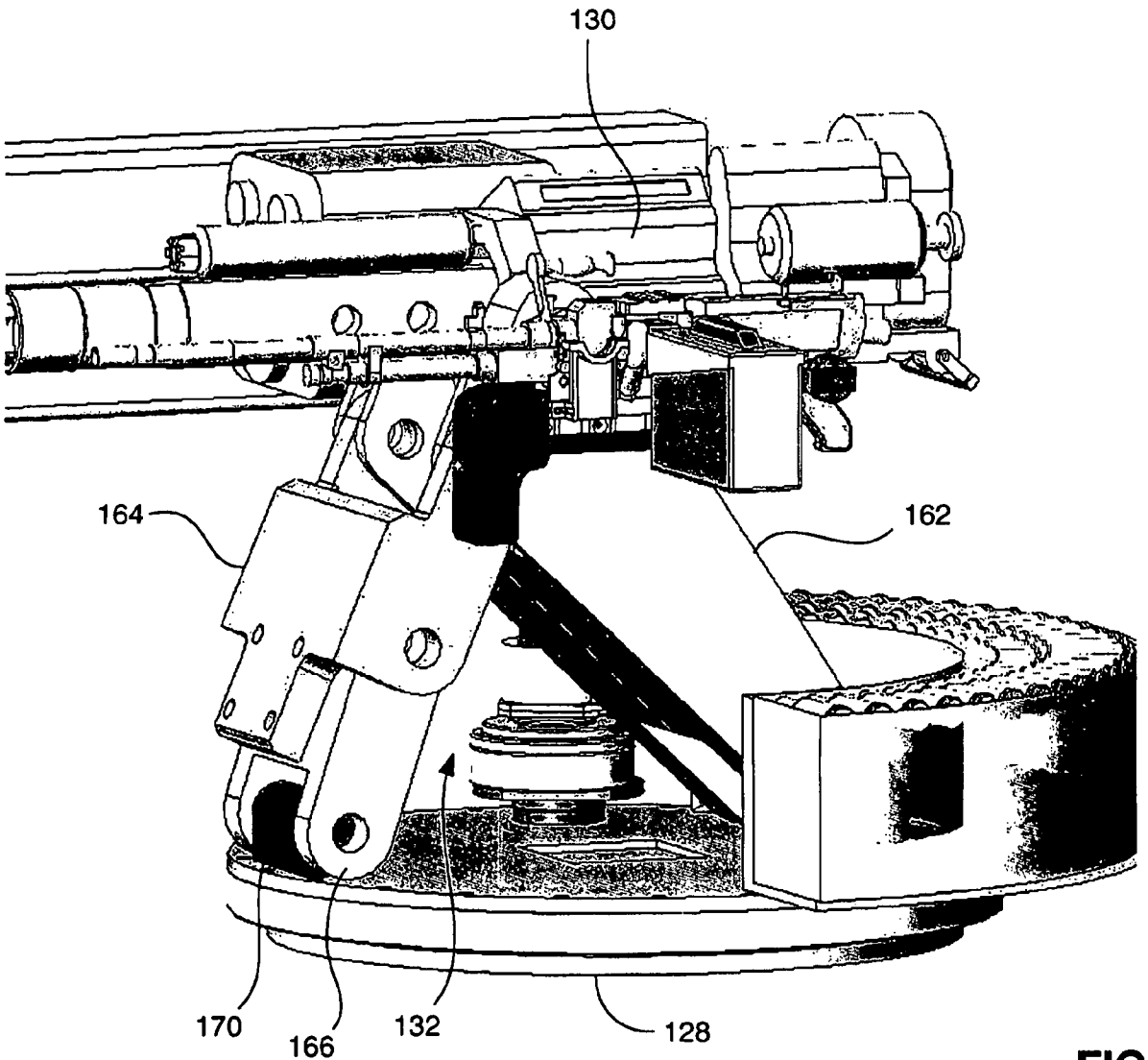
FIG. 5F is a detail perspective side view of the exposed portion of the land vehicle weapon system of FIG. 1 in a further static firing configuration.

Reference is further made to FIGS. 5A, 5B, 5C, 5D, 5E and 5F. FIG. 5A is a perspective top view of the exposed portion of the land vehicle weapon system of FIG. 1, in a transportation configuration. FIG. 5B is a detail perspective side view of the exposed portion of the land vehicle weapon system of FIG. 1, in the transportation configuration of FIG. 5A. FIG. 5C is a detail perspective side view of the exposed portion of the land vehicle weapon system of FIG. 1 in a combined configuration. FIG. 5D is a detail perspective side view of the exposed portion of the land vehicle weapon system of FIG. 1 in another combined configuration. FIG. 5E is a detail perspective side view of the exposed portion of the land vehicle weapon system of FIG. 1 in a further combined configuration. FIG. 5F is a detail perspective side view of the exposed portion of the land vehicle weapon system of FIG. 1 in a further static firing configuration.

Weapon moving mechanism 132 is a mechanism which moves weapon mount 130 and the weapons, from the transportation configuration (FIG. 5A) to the static firing configuration (FIG. 5F), and back (i.e., to a plurality of combined configurations), along vertical axis 152 (FIG. 1), while the weapons remain substantially horizontal with roof 160 (FIG.

1) of land vehicle 102. Alternatively, at each of these combined configurations, the respective moving element can change the elevation of either one of the weapons, as illustrated in FIG. 3, and as described herein below in connection with FIG. 6B. It is noted that lowering of the exposed portion of system 100 toward roof 160 to the transportation configuration, reduces the volume occupied by land vehicle 102, thereby making possible for land vehicle 102 to enter a confined space, such as a cargo bay (not shown) of an aircraft (not shown), marine vessel (not shown), rail vehicle (not shown), and the like.

Figure 6A:
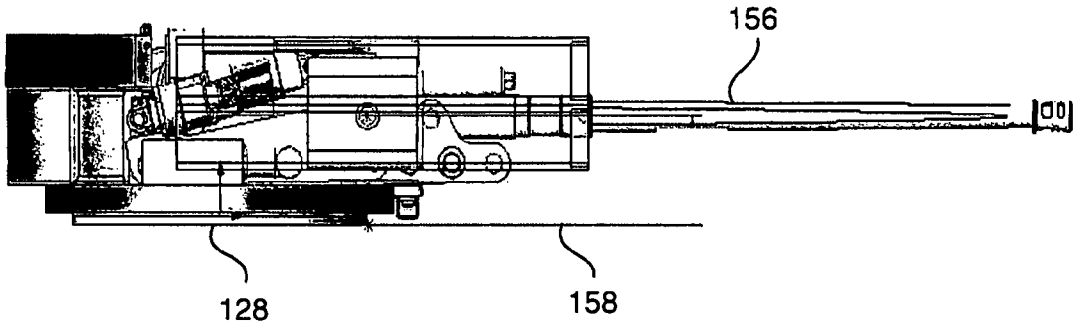
FIG. 6A is a schematic side view illustration of the weapon of the system of FIG. 1, in another transportation configuration.
Figure 6B:
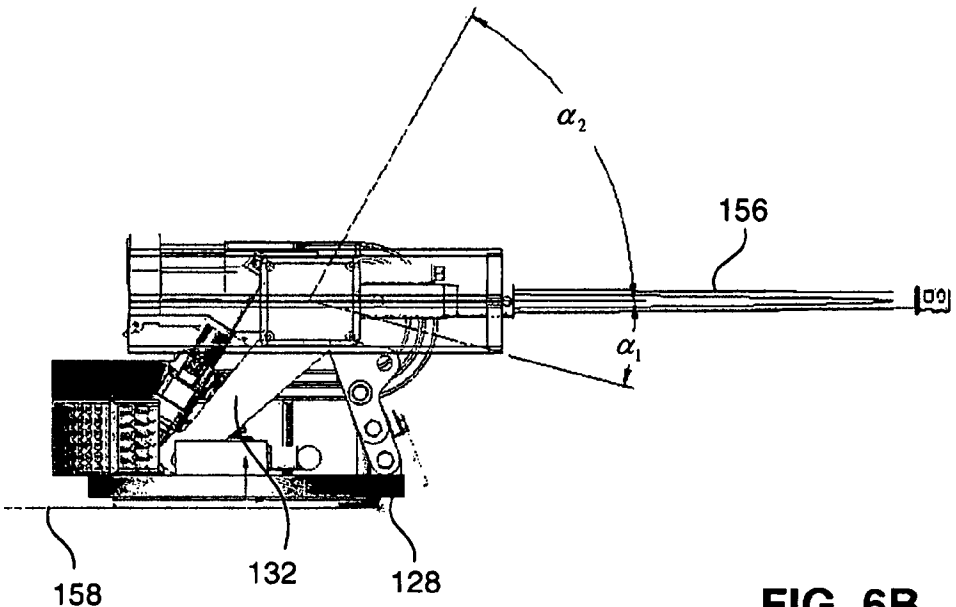
FIG. 6B is a schematic side view illustration of the weapon of the system of FIG. 1, in another static firing configuration.
Figure 6C:
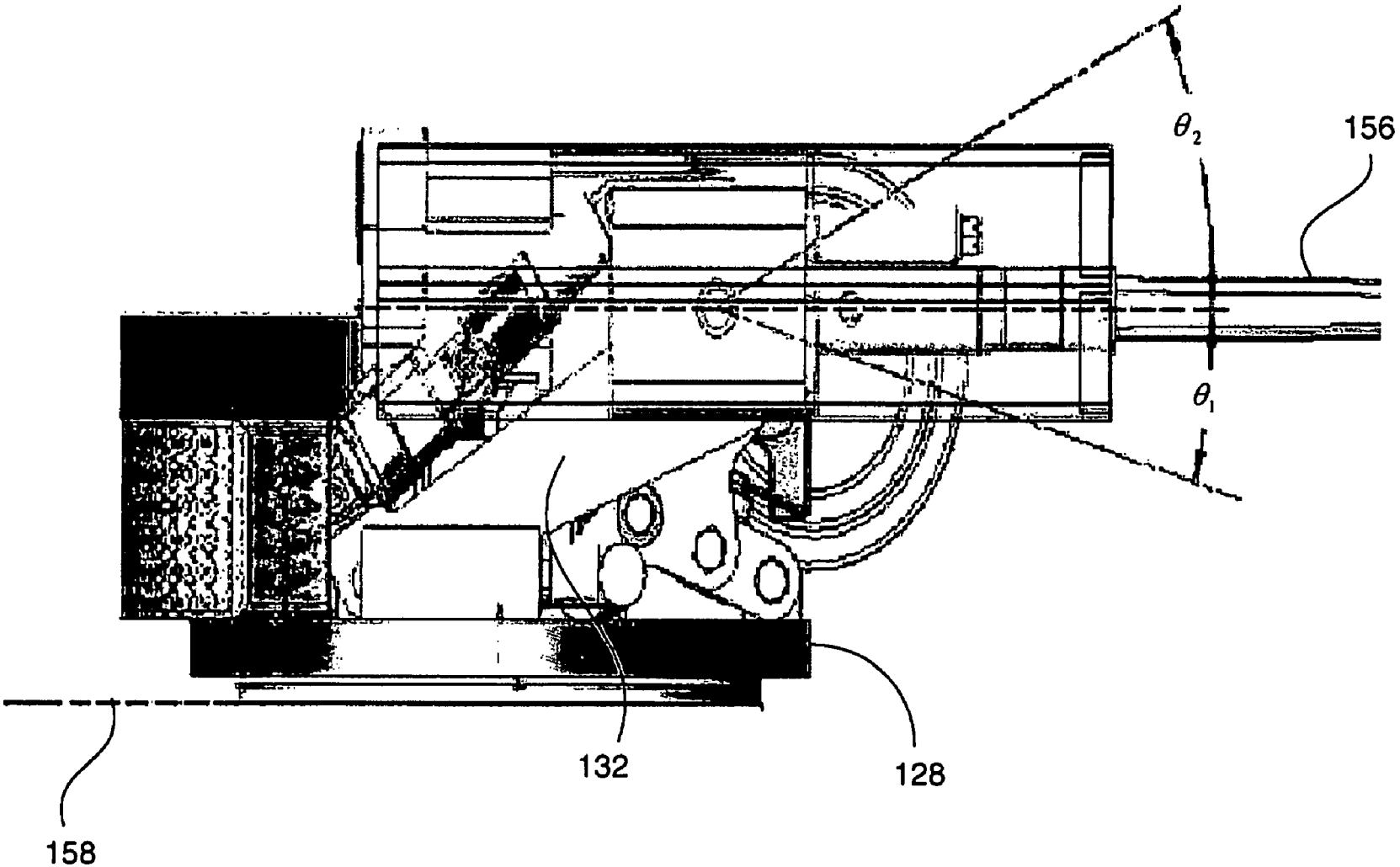
FIG. 6C is a schematic side view illustration of the weapon of the system of FIG. 1, in another combined configuration.
Figure 7:
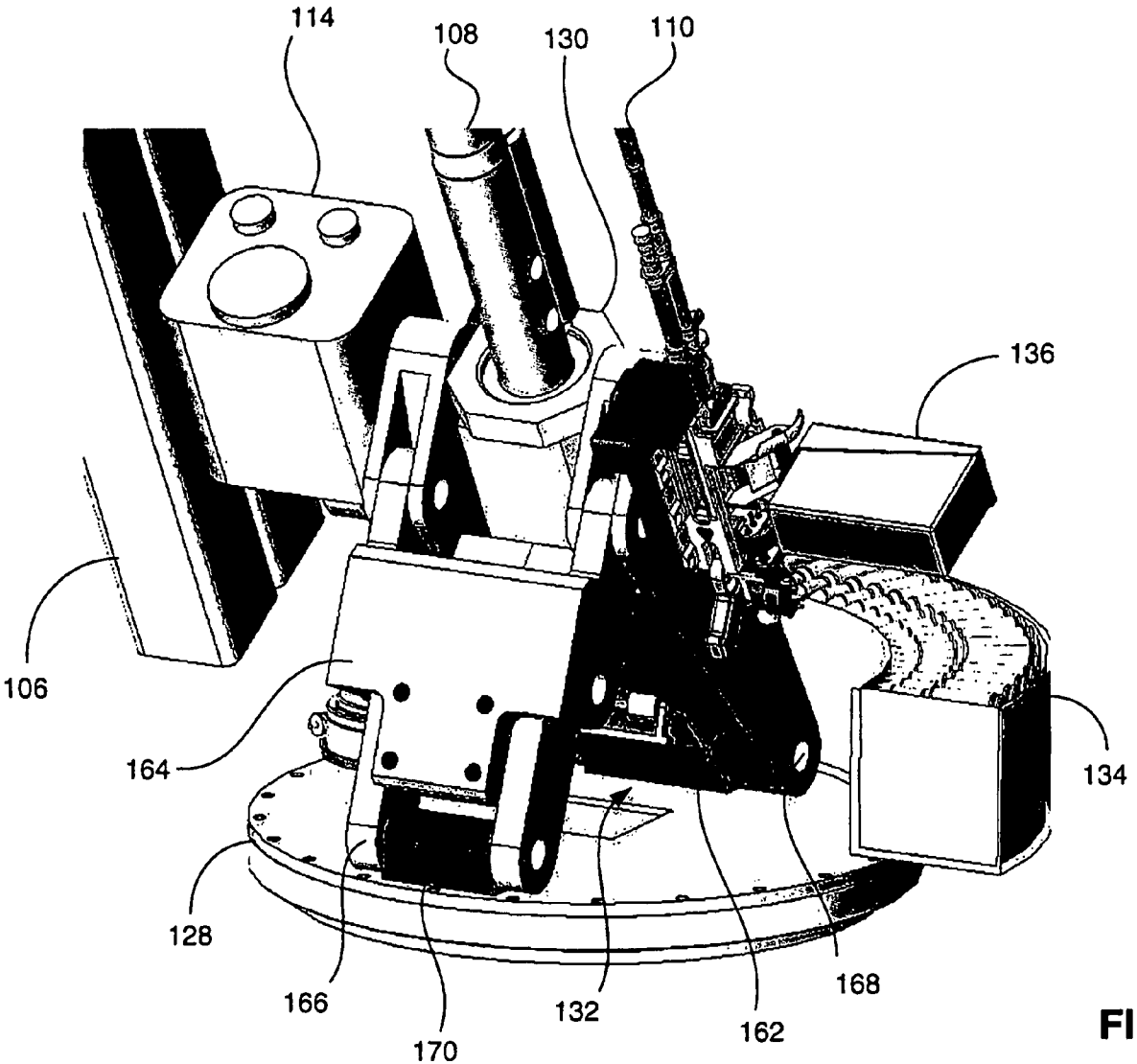
FIG. 7 is a detail front perspective view of the exposed portion of the system of FIG. 1, in a further static firing configuration and at a positive elevation.

Reference is further made to FIGS. 6A, 6B and 7. FIG. 6A is a schematic side view illustration of a weapon, generally referenced 156, of the system of FIG. 1, in another transportation configuration. FIG. 6B is a schematic side view illustration of the weapon of the system of FIG. 1, in another static firing configuration. FIG. 6C is a schematic side view illustration of the weapon of the system of FIG. 1, in another combined configuration. FIG. 7 is a detail front perspective view of the exposed portion of the system of FIG. 1, in a further static firing configuration and at a positive elevation.

With reference to FIG. 6A, weapon 156 is in a transportation configuration and at a substantially zero elevation. With reference to FIG. 6B, weapon moving mechanism 132 has moved weapon 156 to a static firing configuration. At this static firing configuration, the moving element (not shown) can vary the elevation of weapon 156 between an angle $\alpha_1$ below the horizon (reference 158), to another angle $\alpha_2$ above the horizon, where $\alpha_2>\alpha_1$. With reference to FIG. 6C, weapon moving mechanism 132 has moved weapon 156 to a combined configuration. At this combined configuration, the moving element can vary the elevation of weapon 156 between an angle $\theta_1$ below the horizon, to another angle $\theta_2$ above the horizon, where $\theta_2>\theta_1$, $\alpha_2>\alpha_2$, and $\alpha_1=\theta_1$.

Figure 8A:
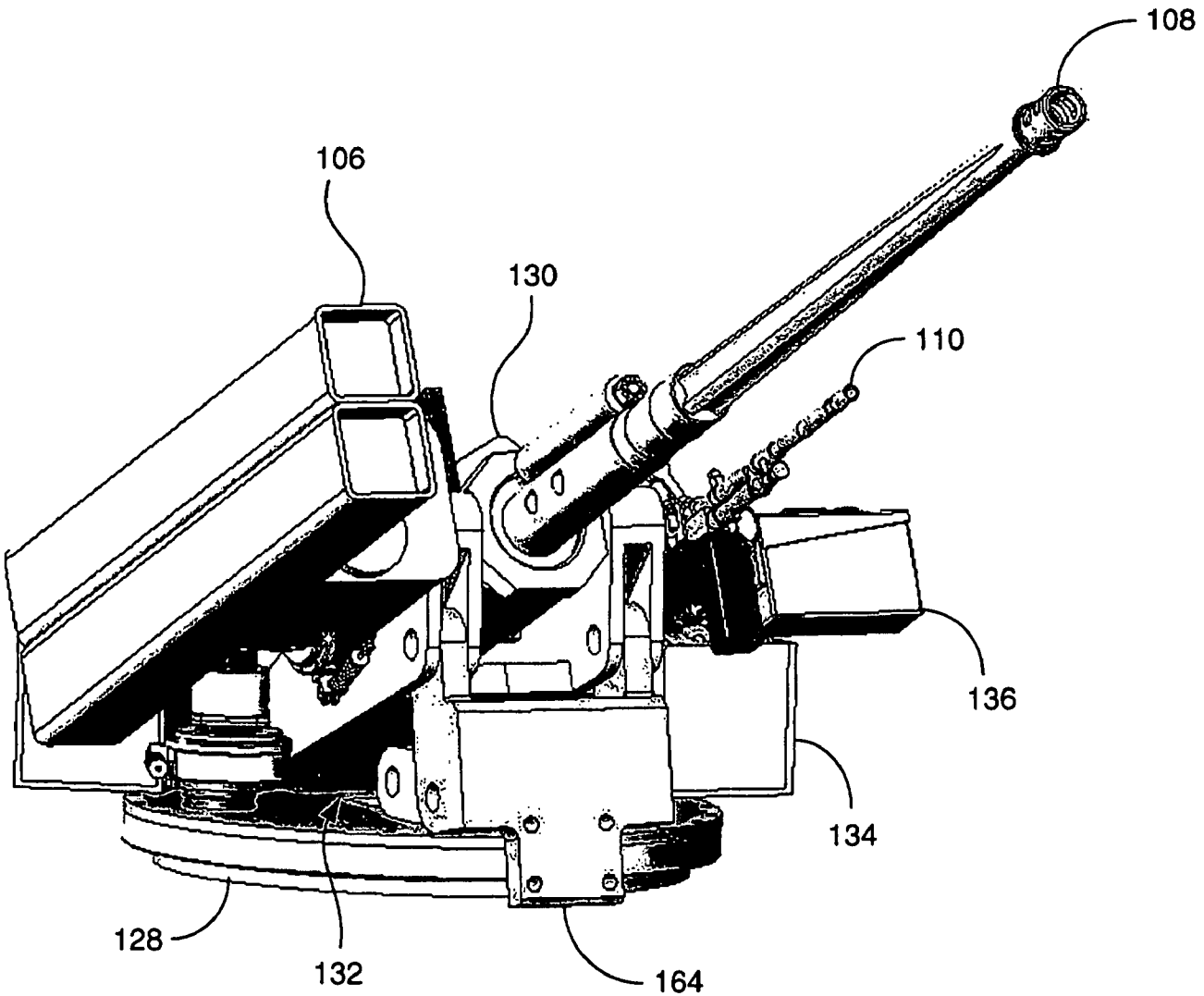
FIG. 8A is a perspective front view of the exposed portion of the system of FIG. 1, in another combined configuration.
Figure 8B:
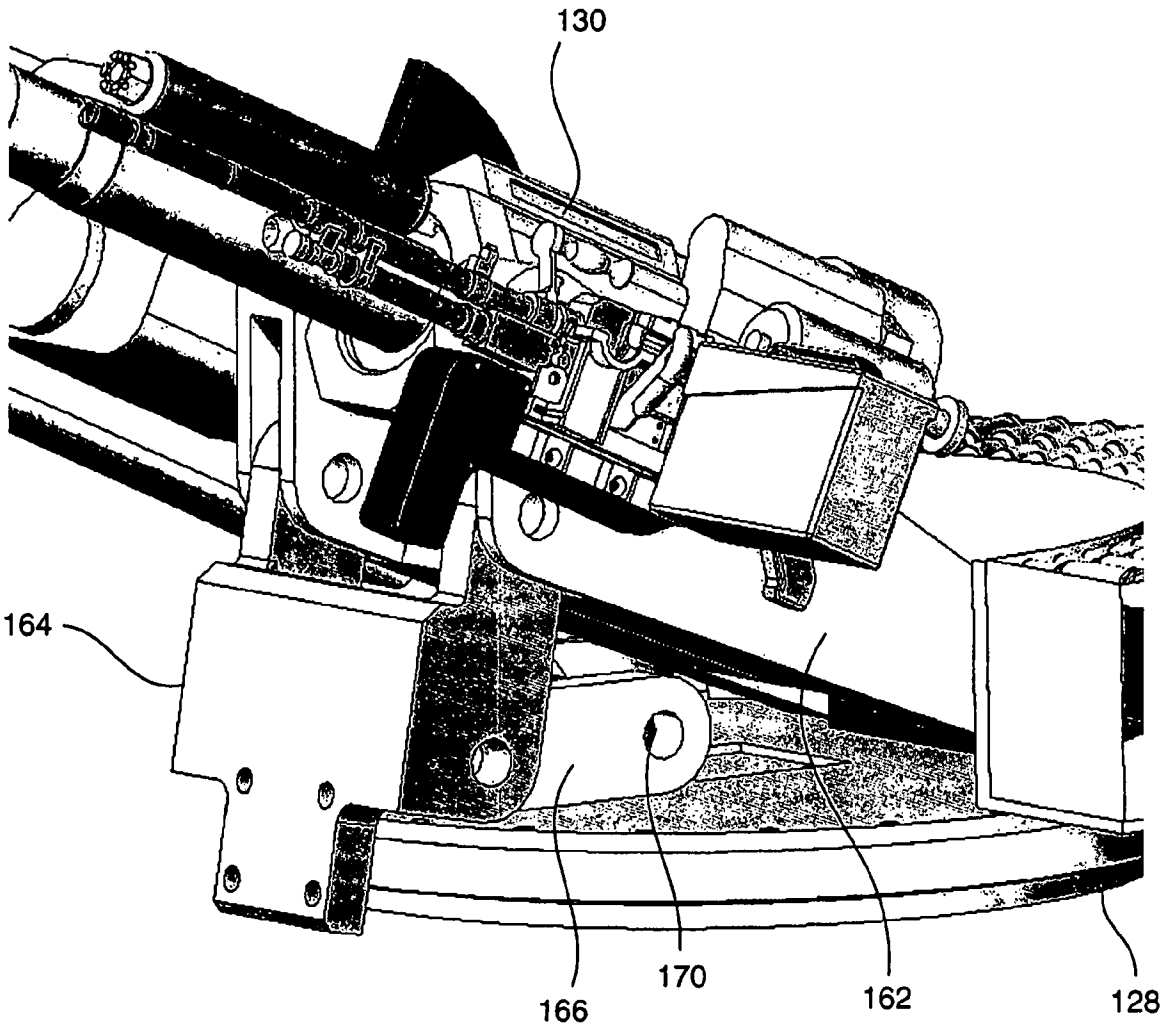
FIG. 8B is a detail perspective side view of the exposed portion of the system of FIG. 1, in the combined configuration of FIG. 8A.

Reference is further made to FIGS. 8A and 8B. FIG. 8A is a perspective front view of the exposed portion of the system of FIG. 1, in another combined configuration. FIG. 8B is a detail perspective side view of the exposed portion of the system of FIG. 1, in the combined configuration of FIG. 8A. At the combined configuration, the weapons of system 100 are functional for combat, notwithstanding the range of elevations of the weapons are less than that of the static firing configuration.

It is noted that in the static firing configuration, as illustrated in any of FIGS. 1, 3, 4, 5F, 6B, and 7, the height of weapon mount 130 from roof 160 (i.e., static firing height), is greater than the height of weapon mount 130 from roof 160 in the transportation configuration (i.e., transportation height), as illustrated in any of FIGS. 5A, 5B, 6A, 8A, and 8B. Thus, in the static firing configuration, the weapons can be moved within a range of angles $\alpha_2$ (FIG. 6B) above the horizon, which is greater than in the case of the transportation configuration.

It is further noted that roof 160 on which system 100 is to be installed does not need to be modified (e.g., by producing a hole, such as in conventional systems which place some of the mechanical elements inside a crew compartment of the vehicle). All the components of system 100 except controller 122 and user interface 126, are located external to land vehicle 102. Hence, the major parts of system 100 (i.e., those which occupy the most volume), are mounted on land vehicle 102 in a way which does not require penetration of hull 150, thereby maintaining the original work space for the crew members of land vehicle 102. The only modifications necessary are directed at affixing system 100 to the outer portion of a selected surface of land vehicle 102.

With reference to FIG. 1, base mount 128 can be fixed to roof 160, external to land vehicle 102, by different welding techniques as known in the art, by employing an adhesive, and the like, or a combination of fasteners (not shown), welding, and adhesives. Alternatively, base mount 128 can be installed onto roof 160 with the aid of a plurality of fasteners, such as bolts, screws, rivets, pins, and the like, which are inserted into respective small drill holes or holes formed in a casting process.

It will be appreciated by persons skilled in the art that the disclosed technique is not limited to what has been particularly shown and described hereinabove. Rather the scope of the disclosed technique is defined only by the claims, which follow.

The invention claimed is:

1. Land vehicle weapon system comprising:

a base mount coupled with a land vehicle;

a weapon mount;

a plurality of weapons coupled with said weapon mount;

a weapon moving mechanism coupled between said base mount and said weapon mount, said weapon moving mechanism being operable to move said weapons to a combined configuration, between a transportation configuration and a static firing configuration;

a plurality of moving elements coupled with at least one of said base mount, said weapon mount, said weapons, and with said weapon moving mechanism;

a sensing mechanism coupled with at least one of said weapon mount, said weapons and said base mount; and at least one user interface coupled with said weapons, said weapon moving mechanism, said moving elements, and with said sensing mechanism, said at least one user interface enabling a user to remotely operate said weapons, wherein said weapon moving mechanism comprises a four bar linkage having a first link, a second link, a third link and a fourth link, wherein the fourth link is fixed and is the same as said base mount, the first link of said four bar linkage being rotatably coupled with said fourth link, the second link of said four bar linkage being rotatably coupled with said first link and with the third link of said four bar linkage, said third link being slidably coupled with said fourth link, allowing said third link to slide along said fourth link, said weapon mount being rotatably coupled with a joint between said first link and said second link, said weapon moving mechanism being in said transportation configuration, when said first link, said second link, and said third link are substantially aligned along a substantially horizontal flat plane, said weapon moving mechanism being in said static firing configuration, when said four bar linkage forms a substantially triangular geometric form, said weapon moving mechanism being in said combined configuration when said third link slides along said fourth link and said four bar linkage forms a substantially quadrilateral geometric shape.

2. The system according to claim 1, wherein said weapon moving mechanism moves said weapons to a combined configuration, between a transportation configuration and a static firing configuration.

3. The system according to claim 1, wherein said weapons are selected from the list consisting of:

cannon;

mortar;

machine gun;

sub-machine gun;

coaxial machine gun;

rifle;

missile launcher; and automatic grenade launcher.

4. The system according to claim 1, further comprising a chemical compound dispenser coupled with said weapon mount.

5. The system according to claim 4, wherein said chemical compound dispenser dispenses a chemical compound selected from the list consisting of:

smoke;

gas;

foam; and liquid.

6. The system according to claim 1, wherein each of said moving elements is selected from the list consisting of:

electric actuator;

mechanical actuator;

hydraulic actuator; and pneumatic actuator.

7. The system according to claim 1, wherein said sensing mechanism comprises at least one sensor.

8. The system according to claim 7, wherein said at least one sensor is selected from the list consisting of:

laser sensor;

sonic sensor;

radar; and mechanical sensor.

9. The system according to claim 1, wherein said sensing mechanism comprises an imaging system.

10. The system according to claim 9, wherein said imaging system is selected from the list consisting of:

charge-coupled device; and video camera.

11. The system according to claim 10, wherein said video camera operates in a visible range of wavelengths.

12. The system according to claim 10, wherein said video camera operates in a non-visible range of wavelengths.

13. The system according to claim 1, wherein the type of said at least one user interface is selected from the list consisting of:

tactile;

visual;

audio; and haptic.

14. The system according to claim 1, wherein said at least one user interface is located within said land vehicle.

15. The system according to claim 1, further comprising a target tracking system coupled with said weapon mount.

16. The system according to claim 1, further comprising a laser designator coupled with said weapon mount.

17. The system according to claim 1, wherein at least one of said moving elements rotates said base mount about a vertical axis substantially perpendicular to a longitudinal axis of said land vehicle.

18. The system according to claim 1, wherein at least one of said moving elements changes the elevation of said weapons.

19. The system according to claim 1, wherein said weapon moving mechanism changes the height of said weapons above a roof of said land vehicle.

20. The system according to claim 1, further comprising a stabilization system coupled with at least one of said weapons, said stabilization system stabilizing the orientation of said at least one weapon, according to the position of a target, and according to the movement of said land vehicle.

21. The system according to claim 1, further comprising at least one ammunition cartridge coupled with a respective one of said weapons.

22. The system according to claim 1, further comprising at least one communication interface coupled with said weapons, said moving elements, said weapon moving mechanism, said sensing mechanism, and said user interface.

23. The system according to claim 22, wherein the coupling of said at least one communication interface with said weapons, said moving elements, said weapon moving mechanism, said sensing mechanism, and said user interface, is selected from the list consisting of:

conductive; and wireless.

24. The system according to claim 1, wherein said land vehicle is selected from the list consisting of:

wheel driven;

track driven; and a combination of the above.

25. The system according to claim 1, wherein said land vehicle is an unmanned land vehicle.

26. The system according to claim 1, wherein said weapon moving mechanism moves said weapons between a static firing configuration and a transportation configuration, said static firing configuration having a static firing height with respect to said base mount, said transportation configuration having a transportation height with respect to said base mount, said static firing height being greater than said transportation height, wherein the elevation in said static firing configuration is characterized by a first range of angles and the elevation in said transportation configuration is characterized by a second range of angles, and wherein said first range of angles is greater than said second range of angles.

27. The system according to claim 1, wherein said base mount is coupled to an outer surface of said land vehicle, without physically penetrating the hull of said land vehicle.

* * * * *